United States Patent [19]

Abu-Shumays et al.

[11] Patent Number: 4,667,961

[45] Date of Patent: May 26, 1987

[54] STAR PRISM PUZZLES GENERALIZED

[76] Inventors: Ibrahim K. Abu-Shumays; Mary D. Abu-Shumays, both of 1248 Varner Rd., Pittsburgh, Pa. 15227

[21] Appl. No.: 828,539

[22] Filed: Feb. 12, 1986

Related U.S. Application Data

[63] Continuation-in-part of Ser. No. 687,167, Dec. 28, 1984, Pat. No. 4,586,713, which is a continuation-in-part of Ser. No. 604,941, Apr. 27, 1984, abandoned, which is a continuation-in-part of Ser. No. 394,869, Jul. 2, 1982, Pat. No. 4,593,907.

[51] Int. Cl.[4] ..... A63F 9/08

[52] U.S. Cl. ..... 273/153 S; 446/487

[58] Field of Search ..... 273/153 S, 157 R, 160; 446/487

[56] References Cited

U.S. PATENT DOCUMENTS 4,378,116 3/1983 Rubik ..... 273/153 S

FOREIGN PATENT DOCUMENTS 170062 12/1977 Hungary ..... 273/153 S
55-3956 1/1980 Japan ..... 273/153 S
WO83/01203 4/1983 PCT Int'l Appl. ..... 273/153 S

OTHER PUBLICATIONS

P. G. Continental Advertisement, Playthings, Aug. 1981, p. 42.

*Primary Examiner*—Anton O. Oechsle
*Attorney, Agent, or Firm*—William J. Ruano

[57] ABSTRACT

This invention extends and generalizes a family of N-pronged (N=3,4,5,6, . . . ) star-based right prism puzzles given in the references cited. Here the overall shapes of the puzzles and the shapes of their various component structures need no longer be right prisms. Futhermore, each prong can have 3L component structures where L is no longer restricted to be one (L=1). Each N-pronged puzzle is comprised of three layers of component structures, each group of component structures in a layer can rotate together around a principal axis of the puzzle. The component structures in a prong of a puzzle appear in sets, each set is comprised of three component structures which can rotate jointly relative to all other component structures in a plane parallel to the principal axis of the puzzle. Each surface of a puzzle is to be initially assigned a unique color or picture. Various possible rotations (twists and turns) result in mixing up the surface configurations. The object and the challenge is to restore the various surfaces of a puzzle into their original form, or to perform twists and turns that would result in alternate interesting external designs.

15 Claims, 21 Drawing Figures

STAR PRISM PUZZLES GENERALIZED

CONTINUATION-IN-PART

This is a continuation-in-part of application Ser. No. 687,167, filed Dec. 28, 1984, now U.S. Pat. No. No. 4,586,713, which in turn was a continuation-in-part of application Ser. No. 604,941, filed Apr. 27, 1984, abandoned, which in turn was a continuation-in-part of application Ser. No. 394,869, filed July 2, 1982, now U.S. Pat. No. 4,593,907.

BACKGROUND OF THE INVENTION

1. Field of the Invention

This invention relates to a family of star puzzles of the cubic class introduced in U.S. Pat. No. 4,586,713 and in the parent patent application Ser. No. 394,869 filing date July 2, 1982 now U.S. Pat. No. 4,593,907.

Each puzzle is comprised of various pieces which rotate in groups relative to each other in such a way as to alter the surface configurations. The object and the challenge is to perform twists and turns aimed at restoring the surfaces to their original configuration or to other interesting configurations.

2. Relation to the Prior Art This invention generalizes the star prism puzzles introduced in U.S. Pat. No. 4,586,713 and in the parent patent application cited above . internal core part and exactly 3N+2 component structures (N=3, 4, 5, 6, etc.) stacked around it in three layers to form overall shapes of right prisms having bases (prism parallel faces) in the form of stars. A standard star puzzle is used here to denote puzzles of the prior art and is referred to as an N-pronged star, N-point star or N-star if it has an overall shape of a right prism and if its bases are polygons in the form of a star with N prongs (N pointed projecting parts). A generalized star puzzle according to the present invention is a puzzle having three layers of component structures and having N prongs or N pointed projecting parts; each prong is comprised of 3L component structures where L=1, 2, . . . , L may be different for different prongs and must be larger than one for at least one prong. Thus, since the number of component structures in each of the N prongs of a generalized star puzzle according to the present invention must be a multiple of 3, with such a multiple being greater or equal to one (greater than one for at least one prong), it follows that the N prongs must together have 3M component structures where M is a number larger than N. The external visible faces of these generalized star puzzles may, but need not be plane faces. The present invention introduces a variety of shapes, a wide range of challenges, and ease of assembly.

SUMMARY OF THE INVENTION

This invention extends and generalizes the shapes of a class of N-pronged (N=3, 4, 5, 6, . . . ) star puzzles introduced and described in detail in U.S. Pat. No. 4,586,713 and in the parent patent application cited above wherein each puzzle in this class is a right prism with a star base. In the previous invention, each N-pronged star-based right prism puzzle is comprised of three layers of predominantly right prism component pieces; each layer is bounded between two planes parallel to the bases of said star-based right prism. The middle layer of component pieces is comprised of a core part surrounded by N right prism edge component pieces. The core part is comprised of rod axes (pivots) of rotation emanating from the center of the puzzle: N rod axes (pivots) of rotation uniformly distributed in a plane parallel to the bases of the right prism puzzle and two rod axes (pivots) of rotation pointing in opposite directions orthogonal to the bases of the right prism puzzle. Each of the N right prism edge component pieces is adjoined (by means of a screw having a smooth top part supported at its head and surrounded by a spring in a shaft inside said right prism edge component piece) to, and is restricted to freely rotate in place around one of the rod axes which are parallel to the bases of the puzzle. Each of the top and bottom layers is comprised of a central N-sided regular polygon right prism surrounded by N right prism corner component pieces; the central N-sided regular polygon right prism is adjoined (by means of a screw having a smooth top part supported at its head and surrounded by a spring in a shaft inside said central N-sided regular polygon right prism) to, and is restricted to freely rotate in place around a rod axis which extends between the geometric center of its externally invisible base and the geometric center of the puzzle.

The present invention involves extending each of, or extending at least one of the N prongs of the above mentioned star puzzles by modifying its shape and adjoining additional structures to it. A few variations of the external shapes are shown in the illustrations; other variations are also contemplated. The overall shapes are no longer restricted to be right prisms.

All the puzzles introduced here are of the same cubic class whereby the surface configurations can be altered by twists and turns and the challenge is to restore the surfaces to the original configuration or to form other interesting configurations or surface designs. The overall shapes, number of visible external pieces, degree and variety of challenge or internal operational mechanisms are improvements and extensions to those in the references cited above.

No mention is made here of the material to construct these puzzles. It may be plastic, wood, metal, etc., or a combination of different material. Ball bearings between adjacent interfaces to stabilize the rest positions and enhance the quality of motion are desirable as is now standard. Since these items are not new, they are not discussed further.

Exact dimensions are not mentioned, since this is a relative matter and can be varied. Relative dimensions are provided where essential.

BRIEF DESCRIPTION OF THE DRAWINGS

The following drawings illustrate examples of the basic shapes which are the subject of this invention.

FIG. 1 corresponds to FIG. 1*a* of patent U.S. Pat. No. 4,586,713 , and is a view of a three-pronged (three-point) based star puzzle. The exposed face of the puzzle component piece 3 of FIG. 1 is an equilateral triangle.

FIG. 2 is a modification of FIG. 1 formed by truncating the prongs of the puzzle of FIG. 1. Here each prong of the star is a right trapezoidal prism.

FIG. 3 is a puzzle having the overall form of an equilateral triangle right prism and corresponds to a modification of the outside shape of the puzzle of FIG. 1.

FIG. 4 is a puzzle having the overall form of a hexagonal right prism and corresponds to a modification of the outside shape of the puzzle of FIG. 3.

FIGS. 5 and 6 are examples of other puzzles with trapezoidal or rectangular based right prism prongs, formed by modifying the external shape of the puzzles of FIGS. 1 to 4.

FIG. 7 corresponds to FIG. 3 of U.S. Pat. No. 4,586,713 and is a view of a four-pronged (four-point) based star puzzle. The exposed face of the puzzle component piece numbered 4 in FIG. 7 is a square.

FIG. 8 is a puzzle having the overall shape of a cube. This puzzle corresponds to a modification of the outside shape of the puzzle of FIG. 7.

FIG. 9 is a puzzle having the overall shape of a right octahedron prism and corresponds to a modification of (cutting parts of) the outside shape of the puzzle of FIG. 8.

FIG. 10 is a perspective view of a new puzzle formed from puzzles of the type shown in FIG. 1 by subdividing each edge or corner structure (each component of a prong) into two parts and joining these parts together by an appropriate means such as illustrated in connection with FIGS. 17 to 21 below. This idea of subdividing edge and corner component structures 2 and 1 in FIG. 1, also applies to extensions to all of the N-pronged (N>2) puzzles considered in U.S. Pat. No. 4,586,713. The puzzle of FIG. 10 can also be viewed as being formed by adjoining (by an appropriate means) one triangular prism of the appropriate shape and size to each edge 1 and to each corner structure 2 of the puzzle of FIG. 2.

FIG. 11 is a perspective view of a new puzzle formed by adjoining (by an appropriate means) three right prisms (two trapezoidal right prisms and one triangular right prism) of suitable shape and size to each edge structure 1 and to each corner structure 2 of the puzzle of FIG. 5.

FIG. 12 is the analogue of FIG. 10 and is a perspective view of a new cube puzzle formed from the puzzle shown in FIG. 8 by subdividing each edge 1 and corner 2 structure (each component of a prong) into two parts and joining these parts together by an appropriate means such as illustrated in connection with FIGS. 17 to 21 below. The puzzle of FIG. 12 can also be viewed as being formed by adjoining (by an appropriate means) one triangular prism of the appropriate shape and size to each edge structure 1 and to each corner structure 2 of the puzzle of FIG. 9.

FIG. 13 is a perspective view of a puzzle which is essentially the same as the puzzle of FIG. 11 with the external shapes of various component structures of the puzzle of FIG. 11 modified.

FIG. 14 presents a perspective view of a puzzle in the form of a cross which extends the puzzle of FIG. 7 by adjoining rectangular prisms to edge and corner structures of the puzzle shown in FIG. 7. This puzzle of FIG. 14 is intended to illustrate that the puzzles within the scope of the present invention need not be symmetric.

The puzzles of FIGS. 15 and 16 are intended to illustrate that the external parts of the various component structures of the puzzles of the present invention can take on various shapes which may or may not be prisms. FIG. 15 is intended to transform the external component structures of the puzzle of FIG. 10 into the shape of a real or imaginary creature. Likewise the the puzzle of FIG. 16 shows a transformation of the puzzle of FIG. 14 into the shape of an airplane. In the puzzle of FIG. 15 the head can be an integral part of the component structure 3 or can be artificially attached by a knob and aperture, the knob of the type 55 illustrated in FIG. 19 below; the same holds for the shoes. For the puzzle of FIG. 16 it is of interest to alter the relative sizes of the various component structures (See below) and to add artificial wheels possibly motorized. The puzzle of FIG. 15 can be transformed into a creature sitting on a tricycle.

FIG. 17 shows part of the puzzle of FIG. 14 with extensions to two of the prongs of this star puzzle removed. Note the small circular hole 5 which either receives a screw from a component piece 11 (See FIG. 14) to be adjoined to the edge center component piece 1 in FIG. 17 or to receive a knob such as shown in FIG. 19; the net effect being to hold a new structure 11 in place adjacent to the structure 1 and to allow the structure 11 to rotate freely in place relative to the structure 1. Note also the large circular groove 7 intended to support a Knob (8 in FIG. 21) emanating from a new corner component structure 22. FIG. 18 is an expanded view of the component structure 1 modified (a) by the circular aperture 5 described in connection with FIG. 17, and by (b) parts of a circular groove 7 which can hold a knob 8. FIG. 19 shows one of two possible knobs 55 or 555, the one selected being an integral part of a component structure 11, extends from the geometric center of the face of the structure 11 which in the rest position coincides with the face of component structure 1 which contains the aperture 5 and the groove 7; the selected knob fits in a aperture 5 and can freely rotate in place in this aperture. When the cylindrical knob 555 is selected, a button 66 is installed as shown in component structure 1, the button supports a curved rod 6 which in the normal position has a part which fits into a narrow cylindrical part of knob 555 to prevent disassembly. When the button 66 is pressed, the curved rod 6 moves in such a way as to release the knob 555. A spring 666 at the end of the curved rod serves to restore the button 66 and the curved rod 6 to their normal position.

FIGS. 20 and 21 respectively show component structure 2 with a groove 7 which is a continuation of the circular groove 7 of FIG. 18 (See also FIG. 17), and show component structure 22 with a knob 8 which fits in and fills the space in the groove part 7 in component structure 2 of FIG. 20 in such a way as to hold the component structures 2 and 22 next to each other in any of the rest positions or while these component pieces rotate together around the principal axes of the entire puzzle (See below).

DESCRIPTION OF THE PREFERRED EMBODIMENTS

Figure 1:
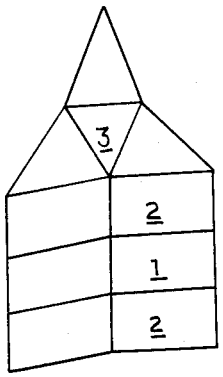
FIGS. 1 to 9 are samples of, and variations to puzzles introduced in the references cited above. All of these puzzles are anticipated in and are certainly within the scope of U.S. Pat. No. 4,586,713.
Figure 2:
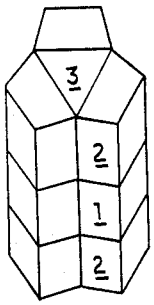
Figure 3:
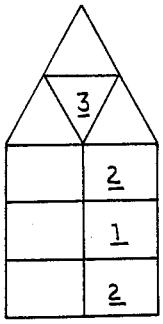
Figure 4:
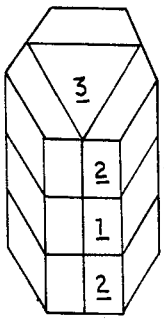
Figure 5:
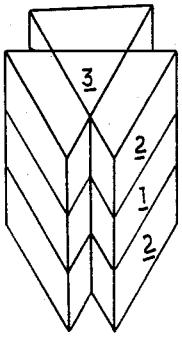
Figure 6:
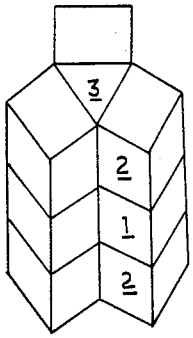
Figure 7:
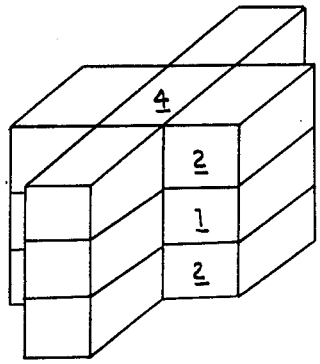
Figure 8:
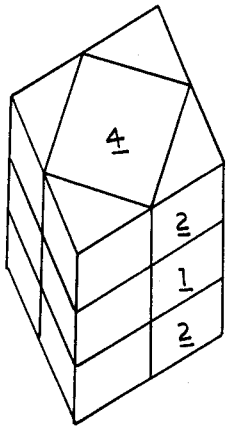
Figure 9:
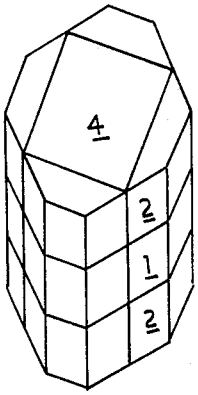
Figure 10:
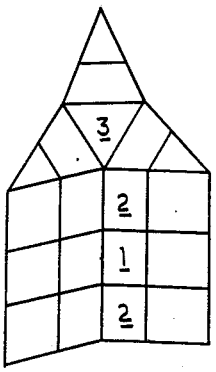
FIGS. 10 to 16 are samples of the extensions to the puzzles of U.S. Pat. No. 4,586,713; such extensions are the main object of the present invention.
Figure 11:
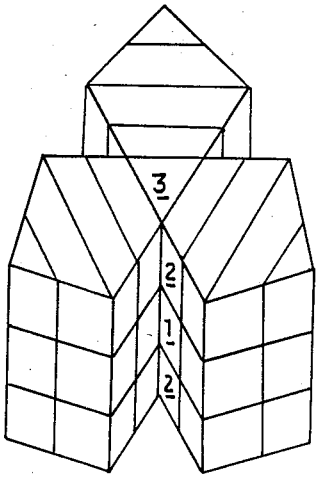
Figure 12:
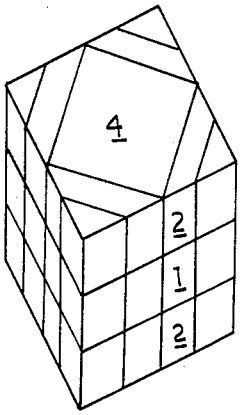

Other objects and advantages of this invention will become more apparent from a study of the description of the drawings given above and from the additional description given here.

The preferred embodiments are the puzzles shown in FIGS. 10 to 16 and similar puzzles having varying shapes.

Each puzzle of this invention, as in the examples in FIGS. 10 to 16, is comprised of a core part (not shown) surrounded by puzzle component structures. The core part is comprised of the following N+2 (N=3, 4, 5, etc.) rod axes pivots emanating from a central point in the puzzle: (i) N identical rod axes pivots uniformly distributed in a plane, and (ii) two rod axes pivots pointing in opposite directions along what is denoted here as the puzzle principal axis; the puzzle principal axis being the line orthogonal to the above mentioned plane of the N identical rod axes pivots. One component structure, 1 or 3 or 4 in the illustrations, etc., is adjoined to each rod axis pivot and is restricted to rotate freely in place around that rod axis pivot.

The puzzle component structures are stacked in three layers which lie above each other, the component structures in each layer can rotate together around the puzzle principal axis. Each of the top and bottom layers of component structures is comprised of a face-center component structure, such as structures 3 and 4 in the various illustrations, surrounded by N prong corner component structures only typical examples of which are marked 2 in the illustrations. At least one of the N corner component structures 2 is extended by further adjoining to it at least one additional component structure 22. Except possibly for its visual part (See FIG. 15), the puzzle face-center component structure such as 3, 4 in the illustrations forms a right prism with an N-sided regular polygon base. The puzzle face-center component structure 3, 4, etc., is mounted along the center of its unexposed base to one of the rod axes pivots along the puzzle principal axis and is restricted to rotate freely in place in a plane orthogonal to that rod axis. One side face of each puzzle corner component structure 2 has the same size as and is situated abutting a side face of a puzzle face-center component structure.

The middle layer of component structures is comprised of N puzzle prong edge component structures 1 each having a face which coincides with a face of a prong corner component structure 2. Each edge component structures 1 is mounted at the center of an unexposed side face of it to one of the N co-planar rod axes pivots mentioned above and is restricted to rotate freely in place around that axis. At least one of the N puzzle prong edge component structures 1 is extended by further adjoining to it one or a group of additional component structures 11.

In the rest reference positions, as in FIGS. 10 to 16, each prong edge component structure 1 is situated between two prong corner component structures 2 to form a complete prong or part of a prong of the puzzle. A prong of the puzzle is formed by a combination of exactly 3L (L=1, 2, . . . ) component structures such as the structures 1, 11, 2, 22 indicated in the illustrations. L of the component structures forming a prong of the puzzle must lie in each of the three layers of component structures. A prong corresponding to L=1 is restricted to one component structure 1 surrounded by two component structures 2. The component structures in each prong of the puzzle can rotate jointly in a plane parallel to the puzzle principal axis; proper rotations here are in multiples of 180 degrees.

In summary, a generalized star puzzle according to the present invention has a central core part comprised of N+2 rod axes pivots (N>2); said central core part is surrounded by 3M+2 main component structures stacked around it in three layers. Two of the main component structures are face-center component structures are situated in the top and bottom layers. The remaining 3M main component structures are divided among the three layers, M in each layer, and are stacked to form N prongs (outward projecting parts) of the puzzle. Here M must be larger than N. In the initial position, the main component structures along a prong appear in groups, each group having three component structures stacked above each other, one structure in each of the three layers of the puzzle. Additional secondary structures can be adjoined to the main component structures of a generalized puzzle, as is discussed above in conjunction with the brief description of the puzzles of FIGS. 15 and 16.

The manner in which the various component structures 1, 2, 3 (or 4, etc., in place of 3) are stacked together, to form the parts of the puzzles of the present invention which correspond to puzzles of the type illustrated in FIGS. 1 to 9, and the knob and groove modifications to such structures are the subject of U.S. Pat. No. 4,586,713 and will not be discussed further here for brevity. Reference is here made to that patent. It suffices here to describe how the component structures 11 are adjoined to the component structures 1 and how the component structures 22 are adjoined to the component structures 2. Component structures 11 in the middle layer of a prong are adjoined to each other in the same manner described below for joining component structures 1 and 11. Similarly component structures 22 in the top or bottom layer of a prong are adjoined to each other in the same manner described below for joining component structures 2 and 22.

Each group of three component structures 2, 1, and 2 above each other in a prong of a puzzle can rotate jointly relative to all other structures, the rotation taking place in a plane parallel to the puzzle principal axis. Proper joint rotations of such component structures 2, 1, 2 are in multiples of 180 degrees.

Similarly groups of three component structures 22, 11, and 22 appear above each other in a prong of a puzzle; each such group can rotate jointly relative to all other structures, the rotation taking place in a plane parallel to the puzzle principal axis. Proper joint rotations of such component structures 22, 11, 22 are in multiples of 180 degrees.

As seen in the illustrations, various puzzles within the scope of the present invention take on various shapes. It is sufficient in the remainder of the specification to illustrate how component structures constituting a prong are joined together by giving the example illustrated in FIGS. 14 and 17–21.

Figure 17:
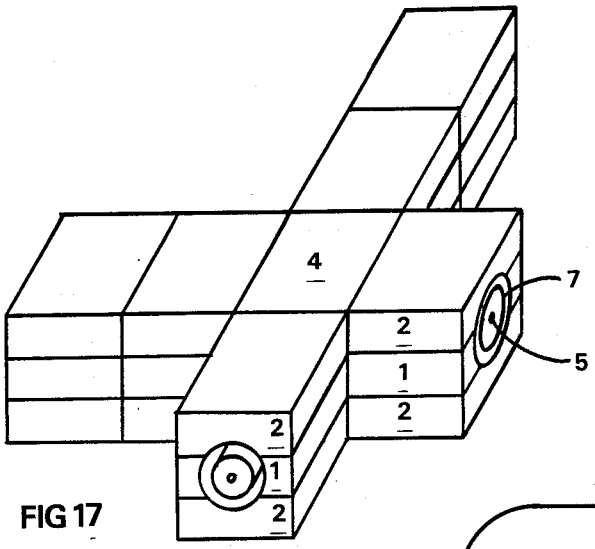
FIGS. 17 to 21 show different views and different magnifications of components of the puzzle of FIG. 14 intended to illustrate how this puzzle is constructed by extending the prongs of the puzzle of FIG. 7.
Figure 18:
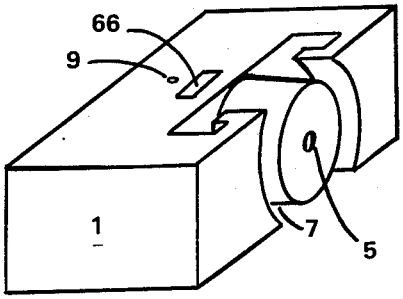
Figure 19:
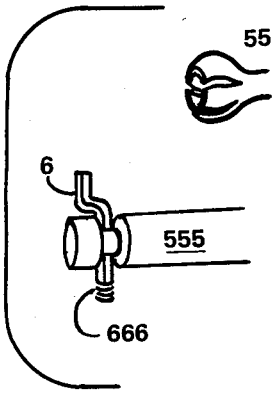

Each component structure 11 has, at the center of its face which in the rest position sits abutting a face of a component structure 1, either (i) a spherical knob 55 (FIG. 19) which fits and can freely rotate in a corresponding spherical aperture 5 (FIGS. 17, 18) in the component structure 1; the spherical knob has a hollow inside and has cuts along its surface; the material structure and construction should make the knob 55 resilient enough to make it possible to repeatedly exert pressure and insert it and remove it through a narrow opening in aperture 5 without jeopardizing the integrity of the puzzle, or (ii) a cylindrical knob 555 (FIG. 19) with a narrow part, the knob fits in a corresponding aperture 5 and is held in place by a curved rod 6 which passes through the narrow part of the knob 555; the curved rod is held in place between a spring 666 and a button 66 (FIGS. 18 and 19). When the button 66 is pressed, the curved rod moves in such a way as to make it possible to re-insert or remove the knob 555 in and out of the aperture 5. The arrangements described here are such as to enable the structure 11 to rotate freely in place around a structure 1 and yet to make it possible to disassemble the structure 11 from the puzzle and reassemble it. Alternatively, if desirable, the component structure 11 can be adjoined permanently to the component structure 1 by means of a screw having a smooth top part supported at its head and surrounded by a spring in a shaft inside the component structure 11 and extending through and fixed to the component structure 1 ; this arrangement is such as to allow component structure 11 to freely rotate in place around the adjacent component structure 1.

Figure 20:
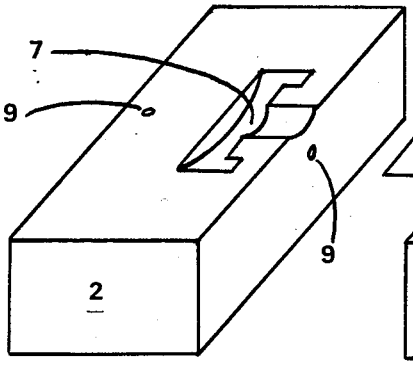

FIG. 20 is a perspective view showing the essentially right prism component structure 2 with partial cylindrical grooves carved around an unexposed edge of this prism 2 (other needed modifications to this structure and to structures 1 are omitted here and are given in U.S. Pat. No. 4,586,713.

Figure 21:
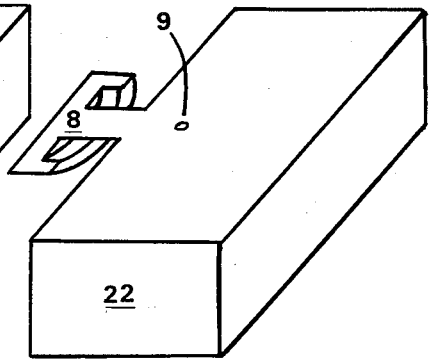

FIG. 21 is a perspective view showing the essentially right prism component structure 22 with partial cylindrical knob 8 fixed to an unexposed edge of this prism 22. Knob 8 which extends the right prism component piece 22, fits in and can move smoothly in and out of the part of the cylindrical groove 7 in the component structure 2.

It is to be noted that in the rest positions the flat edge of the knob 8 is in the same plane as the corresponding side faces of component structures 2 and 22 as is implied in FIGS. 20 and 21.

Note that the cylindrical groove, part of which is shown in FIG. 20 corresponding to component structure 2, extends through the three adjacent structures 2, 1, 2 while they are above each other in a rest position, as is indicated in FIG. 17. The groove 7 in FIGS. 17, 18 and 20 has cylindrical segments with differing radii, the cross-section of the groove has the form of a 90 degree rotated letter J. Note the part of groove 7 shown in FIG. 18 of the perspective view of component structure 1. The axis of the circular apertures is the same as the axis of the groove 5 and is orthogonal to the principal axis of the puzzle.

Ball bearings or combinations of hemi-spherical knobs and indentations at central points between adjacent faces of the puzzle are desirable in order to stabilize the rest positions. Sample of typical locations of ball bearings or protrusions and corresponding indentations aimed at stabilizing the rest positions are indicated by the small circles 9 in FIGS. 18, 20 and 21.

Several other aspects of the invention should now be noted and are desirable in order to clarity the statements of the claims below and to identify the scope of the preferred puzzles.

Note that for clarify the component structures 1 will be referred to in the claims as puzzle prong middle edge component structures, and the component structures 2 will be referred to as puzzle prong corner component structures.

Figure 13:
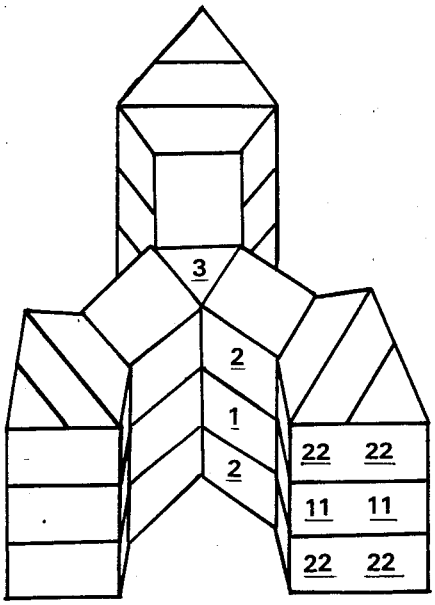

Note from FIG. 13 that in all of the preferred embodiments, any component structure adjoined to a component structure 1 is to be labeled 11 or referred to as such (whether or not it is labeled in the various illustrations), and any component structure adjoined to a component structure 11 is also to be labeled 11 or referred to as such a structure.

Similarly note from FIG. 13 that in all of the preferred embodiments, any component structure adjoined to a component structure 2 is to be labeled 22 or referred to as such, and any component structure adjoined to a component structure 22 is also to be labled 22 or referred to as such a structure.

Note that the means by which component structures 22, 11, 22 are adjoined to component stuctures 2, 1, 2 (i.e. the knobs and grooves) were described in connection with FIGS. 17 to 21. The same means is to be repeated for adjoining each set of component structures 22, 11, 22 to another set 22, 11, 22.

Figure 14:
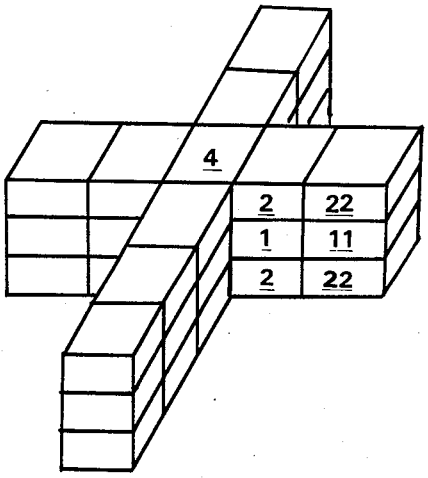
Figure 15:
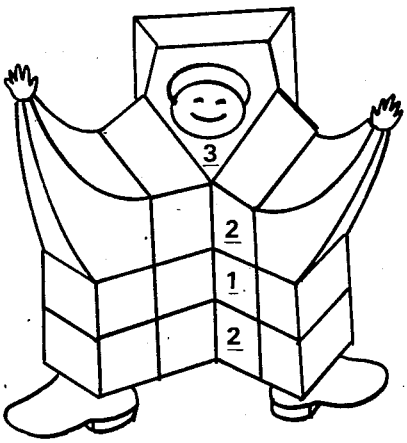

Note from FIG. 14 that for example if the top layer of component structures is rotated by only 45 degrees, then it would be possible to rotate a top structure 22 and disengage its knob 8 from the groove part 7 in the adjacent structure 2 or 22. Yet the shape of the knob 8 and the groove 7 are such as to retain the various structures adjacent to each other during partial rotations. It should also be apparent from FIGS. 18 and 19 that component structures 11 can be removed easily from a puzzle; this is certainly true at least when the corresponding structures 22 are removed as is discussed above. The possibility of disassembling component structures 11 and 22 discussed in this paragraph applies to other puzzles of this invention.

It is most important to have the thickness of the three layers of a puzzle small enough in the neighborhood of each common interface between various component structures in order to ensure that each complete cylindrical groove 7 which extends through three adjacent structures 2, 1, 2 or 22, 11, 22 is, in the rest positions, completely invisible from the outside. In the example of FIGS. 17–21 the common faces of component structures 1, 11, etc., are rectangles and are such that the narrower edge of the rectangle is parallel to the puzzle principal axis. Furthermore, if the layers of component structures are thin enough, then it becomes feasible to alter the various shapes and yet make sure that various component structures, while in their rest positions, do not interfere with, or obstruct the possible rotations of other structures.

It is essential to have all the knobs 8 of component structures 22 which are expected to exchange positions as a result of possible rotations (twists and turns) be identical to each other, and likewise it is essential for the corresponding grooves 7 to be identical to each other. It is highly desirable for all of the knobs 8 and likewise all of the grooves 7 to be identical to each other, as such an arrangement would make it possible to diassemble a puzzle such as that of FIG. 11 or FIG. 13 and reassemble the component structures 22, 11, 22 in different orders and thus interchange locations. In fact it is highly desirable for different sets of puzzles to have sizes of their various component structures 1, 11, 2, 22 be such that they can be removed from one puzzle and inserted into another puzzle, for example, it would be desirable to have the puzzles of FIGS. 13 and 14 be such that their structures 22, 11, 22, can be interchanged or that some of these structures can be removed from one of these puzzles and added to the other puzzle.

Note that component structures 22, 11, 22 (not all labeled in the illustrations) appear in rings around a puzzle principal axis. It is highly desirable (See FIG. 11 in particular) for these rings to be uniformly spaced away from a puzzle principal axis, in which case (i) corresponding interfaces between corresponding component structures 22, 11, 22 in a ring and other component structures would be equidistant from a puzzle principal axis, and furthermore (ii) the order in which such structures appear in a prong can be rearranged as a result of disassembling and reassembling component structures in that prong to result in different overall puzzle shapes.

Figure 16:
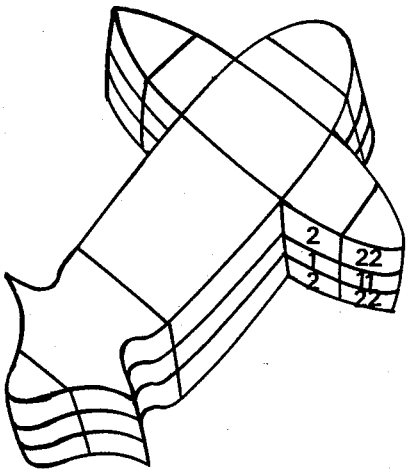

The contents of the preceeding paragraph apply to FIGS. 10–12 and 14 but certainly do not apply to FIG. 16, where the possibilities for various rotations are somewhat limited. An intentional undesirable case is shown in FIG. 16 in order to illustrate a point. Ideally, the four sets of component structures 2, 1, 2 surrounding the central part of this FIG. 16 should be of comparable size so that 90 degree rotations in this puzzle would result in interchanging parts of wings and body structure and still allow the new combinations to rotate along directions orthogonal to the puzzle's principal axis. In brief the shape in FIG. 16 can be maintained and the locations of the subdivisions of the various parts altered in such a way that possible rotations of puzzle layers do not interfere with rotations of new combinations of component structures 22, 11, 22, or 2, 1, 2. Note for illustration that the various parts of the puzzle of FIG. 15 can be different and yet can interchange positions and make possible various rotations.

Various designs, colors or pictures can be assigned to different parts of a puzzle, and there are no limitations to the possibilities. One of the possibilities for example is to construct a calendar where the dates for each month of the year appear on a vertical side of a puzzle such as the puzzles of FIGS. 7 and 14. This is also desirable for the puzzle in FIG. 1*d* of application Ser. No. 687,167, filed Dec. 28, 1984, or for an obvious generalization of that puzzle formed by subdividing each of its edge and corner component structures into two parts and adjoining these structures together as was discussed above in connection with FIGS. 1 and 10.

While we have illustrated and described several embodiments of our invention, it will be understood that these are by way of illustration only and that various changes, extensions and modifications may be contemplated in this invention and within the scope of the following claims.

We claim:

1. A geometrical puzzle comprised of a core part surrounded by exactly 3M+2 puzzle component structures; the overall shape of the puzzle having a central section and N prongs (outward projecting parts); the numbers N and M are such that N is at least 3 (N=3, 4, 5, 6, etc.) and M is larger than N;

said core part is comprised of N+2 fixed rod axes pivots emanating from a central point of the puzzle; N of said N+2 fixed rod axes pivots are uniformly distributed in a plane passing through said central point of the puzzle; the remaining two of said N+2 fixed rod axes pivots point in opposite directions along the puzzle principal axis which is the line passing through said central point of the puzzle and being orthogonal to said plane passing through said central point of the puzzle;

said 3M+2 puzzle component structures are initially stacked in three layers, the component structures in each layer can rotate together around said puzzle principal axis; each of the top and bottom layers of component structures is comprised of a puzzle face-center component structure surrounded by N puzzle prong corner component structures; said puzzle face-center component structure is predominantly in the form of a right prism with an N-sided regular polygon base not visible from the outside; each said puzzle face-center component structure is mounted at the center of its said N-sided regular polygon base to one of the rod axes pivots lying along the puzzle principal axis, such mounting is by means of a screw extending to the rod axis pivot, the screw is supported at its head and surrounded by a spring in a shaft inside said puzzle face-center component structure; said puzzle face-center component structure is restricted to rotate freely in place around said puzzle principal axis; one side face of each of said puzzle prong corner component structures has the same size as and is initially situated abutting a side face of a puzzle face-center component structure;

the remaining middle layer of component structures is comprised of M component structures, N of which are puzzle prong middle edge component structures; each puzzle prong middle edge component structure has one unexposed side face situated orthogonal to and being mounted at its center and fixed to one of said N of said N+2 fixed rod axes pivots; each puzzle prong middle edge component structure is restricted to rotate freely in place around that rod axis pivot fixed to its said unexposed side face;

initially each of said puzzle prong middle edge component structures is situated between two of said puzzle prong corner component structures; the puzzle prong middle edge component structure has, around the externally invisible edges of its said unexposed side face which is adjoined to a rod axis pivot, cylindrical indentations with varying cylindrical radii forming internal edge grooves, the cross-section of each internal edge groove having the form of a forward or a backward letter J relative to said puzzle principal axis; in the initial position, the cylindrical axes of the internal edge grooves are the same as said puzzle principal axis; each puzzle prong corner component structure has a knob which fills, fits in and can move freely in and out of a groove in an adjacent puzzle prong middle edge component structure;

each prong of the puzzle is comprised of one or more sets of component structures; each set of component structures is comprised of three component structures stacked above each other, a middle layer component structure surrounded by two prong side component structures, one prong side component structure lies in the top and one lies in the bottom layer of the puzzle; said puzzle prong middle edge component structure being a special case of said middle layer component structure; said puzzle prong corner component structure is a special case of said prong side component structure;

each two sets of component structures which are adjacent to each other in a prong of the puzzle share a common interface and are adjoined to each other by means of knobs and grooves, the grooves occur in the set of component structures closest to said puzzle principal axis to be referred to here as the inner set, and the knobs are integral parts of (fixed permanently to) the other set of component structures to be referred to here as the outer set;

a small circular aperture is formed in the middle layer component structure of the inner set, around the center of said common interface, this aperture receives a knob of comparable size affixed to the center of the abutting face of the adjacent middle layer component structure of the outer set of component structures; said small circular aperture and said knob of comparable size are selected such as to make it possible for adjacent middle layer component structures to rotate freely in place around each other, and also to make it possible by suitable means to easily disassemble and reassemble the middle layer component structures of the outer set of component structures;

a cylindrical groove is formed starting at said common interface, and extending through the three adjacent structures of the inner set of component structures; this groove has cylindrical segments with differing radii, the cross-section of the groove has the form of a 90 degree rotated letter J relative to said puzzle principal axis; the axis of the cylindrical groove is the same as the axis of said small circular aperture and is along a line in a plane orthogonal to said puzzle principal axis; a partly cylindrical knob, also having the form of a rotated letter J, is fixed to each of the prong side component structures of the outer set of component structures; said partly cylindrical knob fills the space of the part of the cylindrical groove in a prong side component structure of the inner set of component structures, fits in and can move smoothly in and out of that part of the cylindrical groove; the size and shape of each set of component structures is selected such that the grooves and knobs are invisible from the outside in the rest positions;

all the knobs of component structures which are expected to exchange positions, as a result of possible rotations (twists and turns), etc., are selected to be identical to each other, and likewise the corresponding grooves are selected to be identical to each other;

each puzzle face-center component structure can rotate around said puzzle principal axis together with all of the N puzzle prong corner component structures which lie with it in the same layer of component structures; proper rotations in this case are in multiples of 360/N degrees; the knobs in the puzzle prong corner component structures and the grooves in the puzzle prong edge component structures must be large enough to prevent disassembly of the puzzle component structures during such rotations; the sets of component structures which are adjoined to each other in a puzzle prong can be disassembled during partial rotations;

each puzzle prong middle edge component structure can rotate together with its two adjacent puzzle prong corner component structures in a plane parallel to said puzzle principal axis; proper rotations in this case are in multiples of 180 degrees; also the combination of knobs and grooves serves to prevent disassembly in this case;

each of said one or more sets of component structures in a puzzle prong can rotate, relative to other component structures, in a plane parallel to said puzzle principal axis; proper rotations in this case are in multiples of 180 degrees; also the combination of knobs and grooves serves to prevent disassembly in this case;

at least selected pairs of surfaces of said puzzle component structures which coincide with each other in a rest position between rotations are initially modified at their centers by a combination of a small hemi-spherical knob on one and the same size hemi-spherical indentation on the other, the hemi-spherical knobs being identical to each other and being situated on surfaces of puzzle component structures which can exchange positions as a result of permissible rotations; hemi-spherical knobs and indentations serve to stabilize the rest positions between admissible rotations;

admissible rotations alter the relative positions of the puzzle component structures and alter any initial external surface designs; the object and the challenge is to perform additional rotations to recover said initial external surface designs and to arrive at other new and interesting surface designs.

2. A puzzle as recited in claim 1 having the overall shape of a vehicle.

3. A puzzle as recited in claim 1 having the overall shape of a creature.

4. A puzzle as recited in claim 1 having the overall shape of a right prism and having component structures which are predominantly right prisms.

5. A puzzle as recited in claim 1 wherein initially each prong of the puzzle has the same number of component structures as any other prong of the puzzle.

6. A puzzle as recited in claim 5 wherein the component structures in the prongs of the puzzle appear in rings which are uniformly spaced away from the puzzle principal axis, and wherein several component structures in any one prong can be disassembled and reassembled in different orders in any other prong to yield new different overall puzzle shapes.

7. A group of puzzles each being as recited in claim 5 wherein several of their component structures can be interchanged as a result of disassembling and reassembling them.

8. A group of puzzles each being as recited in claim 6 wherein several of their component structures can be interchanged as a result of disassembling and reassembling them.

9. A puzzle as recited in claim 5 having the overall shape of a right prism and having component structures which are predominantly right prisms.

10. A puzzle as recited in claim 9 having N prongs (N=3,4,5,6, etc.), each prong having the overall shape of an isosceles triangle right prism comprised of six component structures (i) three component structures close to the puzzle center stacked above each other to form a trapezoidal right prism and (ii) the remaining three are stacked above each other to form an isosceles triangle right prism; the thickness of the three layers of the puzzle being smaller than three times the width of a side of each N-sided regular polygon face-center component structure of the puzzle.

11. A puzzle as recited in claim 10 having four (N=4) prongs and having the overall shape of a cube.

12. A puzzle as recited in claim 9 having four (N=4) prongs and having predominantly rectangular right prism component structures.

13. A puzzle as recited in claim 9 having four (N=4) prongs and having a combination of predominantly rectangular, trapezoidal and triangular right prism component structures.

14. A puzzle as recited in claim 9 having three (N=3) prongs and having a combination of predominantly rectangular, trapezoidal and triangular right prism component structures.

15. A geometric puzzle as recited in claim 1 together with additional secondary structures adjoined to it by an appropriate means.

* * * * *